US007752694B2

(12) United States Patent
Koo

(10) Patent No.: US 7,752,694 B2
(45) Date of Patent: Jul. 13, 2010

(54) DEHYDRATION CONTROLLING APPARATUS FOR WASHING MACHINE AND METHOD THEREOF

(75) Inventor: Bon-Kwon Koo, Seongdong-Gu (KR)

(73) Assignee: LG Electronics Inc., Seoul (KR)

( * ) Notice: Subject to any disclaimer, the term of this patent is extended or adjusted under 35 U.S.C. 154(b) by 947 days.

(21) Appl. No.: 11/516,763

(22) Filed: Sep. 7, 2006

(65) Prior Publication Data

US 2007/0050919 A1 Mar. 8, 2007

(30) Foreign Application Priority Data

Sep. 7, 2005 (KR) ..... 10-2005-0083376

(51) Int. Cl.
*D06F 33/02* (2006.01)

(52) U.S. Cl. ..... 8/159; 68/24; 68/58

(58) Field of Classification Search ..... 68/24, 68/140; 8/159

See application file for complete search history.

(56) References Cited

U.S. PATENT DOCUMENTS 2,892,334 A * 6/1959 Gray, Jr. ..... 68/12.15
4,513,464 A * 4/1985 Rettich et al. ..... 8/159
4,782,544 A * 11/1988 Nystuen et al. ..... 8/159
5,075,613 A * 12/1991 Fisher ..... 318/809
5,930,855 A * 8/1999 Vande Haar et al. ..... 8/159
6,023,854 A * 2/2000 Tsunomoto et al. ..... 34/531
7,530,133 B2 * 5/2009 Mitts ..... 8/159
2004/0098813 A1 5/2004 Son
2005/0016227 A1 1/2005 Lee
2006/0010614 A1 1/2006 Yim et al.

FOREIGN PATENT DOCUMENTS

DE 39 11 124 * 10/1990
DE 41 15 776 * 11/1992
EP 0302319 2/1989
EP 1693498 A2 8/2006
FR 2630137 A 10/1989

OTHER PUBLICATIONS

European Patent Office 0 071 308 Feb. 1983.*

* cited by examiner

*Primary Examiner*—Frankie L Stinson
(74) *Attorney, Agent, or Firm*—McKenna Long & Aldridge LLP

(57) ABSTRACT

A dehydration controlling apparatus for a washing machine, and a method thereof. The apparatus including: a storage unit in which an acceleration rate, an allowable maximum unbalance amount and an allowable minimum unbalance amount according to an amount of laundry are pre-stored; and a controlling unit for repeatedly controlling an operation of increasing and decreasing a Rotation Per Minute (RPM) of a motor of the washing machine in a region between the acceptable maximum unbalance amount and the acceptable minimum unbalance amount until an unbalance amount detected is less than the acceptable minimum unbalance amount.

12 Claims, 4 Drawing Sheets

DEHYDRATION CONTROLLING APPARATUS FOR WASHING MACHINE AND METHOD THEREOF

The present disclosure relates to a subject matter contained in priority Korean Application No. 10-2005-0083376, filed on Sep. 7, 2005, which is herein expressly incorporated by reference in its entirety.

BACKGROUND OF THE INVENTION

1. Field of the Invention

The present invention relates to a washing machine, and particularly, to a dehydration controlling apparatus for a washing machine and a method thereof capable of more evenly distributing clothes within the wash tub of the washing machine to prevent noise, vibration and excess energy consumption.

2. Discussion of the Related Art

In general, a washing machine performs a function for washing laundry (i.e., removing contaminants or pollutants such as dirt, oil, stains, or the like from the laundry) by mechanically applying a suitable friction or vibration to the laundry in a laundry detergent.

For this purpose, the washing machine performs a washing stage for applying a mechanical force to the laundry in water mixed with the detergent, rinsing stage for rinsing the detergent containing the contaminant out of the laundry, and a dehydrating stage for removing the rinsed water from the laundry (i.e., dehydrating the laundry).

During the dehydrating stage, the wash tub may become unbalanced if the laundry becomes unevenly-distributed within the wash tub, causing severe vibration and noise within the washing machine.

Accordingly, a function to evenly-distribute the laundry is required for the washing machine. In the related art, this is accomplished by detecting an UnBalance (UB) amount and then evenly distributing the laundry according to the detected UB amount.

FIG. 1 is a flowchart illustrating operations related to an UB amount detecting and dehydrating method of a washing machine according to the related art.

As illustrated in FIG. 1, an UB amount detecting and dehydrating method of a washing machine includes driving the motor of a washing machine at a low speed (S11), sensing a changed amount of a motor speed (i.e., Rotation Per Minute: RPM) of the washing machine according to changes in time to thereby detect an UB amount (S12), comparing the detected UB amount to a preset reference UB amount (S13), and performing a function to evenly-distribute the laundry when the detected UB amount is greater than the reference UB amount (S14A), and dehydrating the laundry by increasing the RPM of the washing machine when the detected UB amount is less than the reference UB amount (S14B).

The detection of the UB amount (S12) will now be explained in detail.

First, a speed detecting unit mounted in the motor of the washing machine is used to measure the RPMs of the motor for a predetermined period of time and changes in the RPMs of the motor are determined.

The maximum changed amount and a minimum changed amount are used to determine the UB amount and the size of the laundry load.

The UB amount determined by employing the method is compared to a reference UB amount corresponding to a preset load amount. Based upon the comparison, when the determined UB amount is greater than the reference UB amount, the motor of the washing machine is stopped to change a spinning direction of the motor. The laundry evenly-distributing function is performed accordingly.

If the determined UB amount is less than the reference UB amount according to the comparison, the RPM of the motor of the washing machine is increased to perform a dehydrating operation in order to remove water contained in the laundry. Thereafter, the RPM is decreased thus to determine the UB amount.

When the UB amount determined is less than the reference UB amount, the dehydration is performed by a faster speed. Then, within a certain time after the RPM of the washing machine reaches a preset dehydrating speed, the RPM of the washing machine is decreased again to re-determined the UB amount. When the UB amount re-determined is greater than the reference UB amount, the motor of the washing machine is stopped to change the rotational direction of the motor, thereby re-performing the laundry evenly-distributing function.

When the UB amount re-determined is less than the reference UB amount, the current RPM of the washing machine is increased to reach a preset dehydrating speed. The dehydration is then performed for a preset time by the preset dehydrating speed to thereafter terminate the dehydration.

When the UB amount determined is less than the reference UB amount a predetermined number of times, the laundry load is considered to be a small load, and accordingly a separate dehydrating algorithm is implemented.

A method for determining a small load may be implemented by comparing the UB amount determined by repeatedly performing the operation of increasing and decreasing the RPM of the motor in a washing machine containing a small amount of laundry to reach the dehydrating speed.

Accordingly, the determination of the small load takes a long time in the related art, and the RPM of the washing machine motor is increased to a relatively high speed, which causes noise and vibration and unnecessary energy consumption.

SUMMARY OF THE INVENTION

Accordingly, the present invention is directed to a dehydration controlling apparatus for a washing machine and method thereof that substantially obviates one or more of the problems due to the limitations and disadvantages of the related art.

An advantage of the present invention is to reduce noise and vibration due to an unbalanced tub in a washing machine.

Another advantage of the present invention is to identify a small load of laundry in the tub to reduce unnecessary energy consumption.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, a dehydration controlling apparatus for a washing machine according to the present invention includes a storage unit in which an acceleration rate, an acceptable maximum unbalance amount and an acceptable minimum unbalance amount according to an amount of laundry are pre-stored, and a controlling unit for repeatedly controlling an operation of increasing and decreasing a RPM of a motor in the washing machine in a range between the acceptable maximum unbalance amount and the acceptable minimum unbalance amount until an unbalance amount detected is less than the acceptable minimum unbalance amount.

In another aspect of the present invention, a dehydration controlling apparatus for a washing machine includes a storage unit in which an acceleration rate, an acceptable maximum unbalance amount and an allowable minimum unbalance amount according to an amount of laundry, and a controlling unit for repeatedly controlling an operation of increasing and decreasing a RPM of a motor of the washing machine in a region between the acceptable maximum unbalance amount and the acceptable minimum unbalance amount until an unbalance amount detected is less than the acceptable minimum unbalance amount, wherein the operation of increasing and decreasing the RPM is repeatedly performed more than a certain number of times, it is determined as a small load thus to separately employ a preset dehydrating algorithm.

In another aspect of the invention, a dehydration controlling method for a washing machine includes setting a region separately having an acceptable maximum unbalance amount and an acceptable minimum unbalance amount, detecting an unbalance amount by increasing or decreasing a RPM of the motor of the washing machine within the set region during a dehydration mode activated, which is repeatedly performed until the unbalance amount detected is less than the acceptable minimum unbalance amount; and sensing as a small load when the operation of increasing and decreasing the RPM of the motor of the washing machine is repeatedly performed over a certain number of times and accordingly performing a separate dehydrating algorithm.

In another aspect of the present invention, a dehydration controlling method for washing machine includes setting a region separately having an acceptable maximum unbalance amount and an acceptable minimum unbalance amount, increasing a RPM of the washing machine motor to detect a first unbalance amount at a first target speed, and increasing the RPM by a certain amount to detect a second unbalance amount when the first unbalance amount is less than a first reference unbalance amount; comparing the second unbalance amount, and, increasing or decreasing the RPM, according to the comparison, until the second unbalance amount is less than the acceptable minimum unbalance amount, increasing the RPM up to a second target speed when the second unbalance amount is less than the acceptable minimum unbalance amount within a certain time, and thereafter comparing a third unbalance amount detected at the second target speed to a second reference unbalance amount, to accordingly determine whether to further increase the RPM of the motor, and sensing as a small load when the operation of increasing and decreasing the RPM of the motor is repeatedly performed over a certain number of times, and accordingly performing a separate dehydrating algorithm.

It is to be understood that both the foregoing general description and the following detailed description are exemplary and explanatory and are intended to provide further explanation of the invention as claimed.

BRIEF DESCRIPTION OF THE DRAWINGS

Reference will now be made in detail to an embodiment of the present invention, example of which is illustrated in the accompanying drawings.

In the drawings.

DETAILED DESCRIPTION OF THE ILLUSTRATED EMBODIMENTS

Description will now be given in detail of the present invention, with reference to the accompanying drawings.

Hereinafter, with reference to the accompanying drawings, explanation will be given of a dehydration controlling apparatus for a washing machine and a method thereof capable of shortening a dehydration initiating time and reducing noise and vibration by more evenly distributing clothes in a centrifugally-distributed region and a clothes tumbling region of a washing machine tub by increasing and/or decreasing the RPM of the motor of the washing machine to allow the detected UB amount at a current RPM of the motor to be within a predetermined range of acceptable UB before the RPM reaches a speed for initiating a final UB amount determination.

Figure 1:
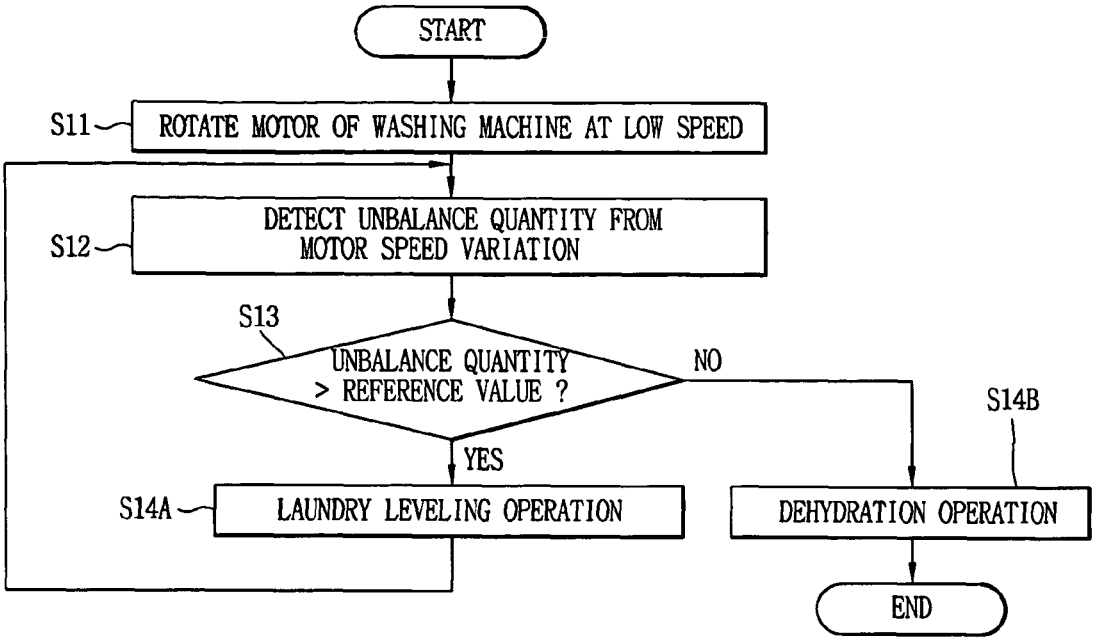
FIG. 1 RELATED ART
FIG. 1 is a flowchart illustrating operations related to an UB amount detecting and dehydrating method of a washing machine according to the related art.
Figure 2:
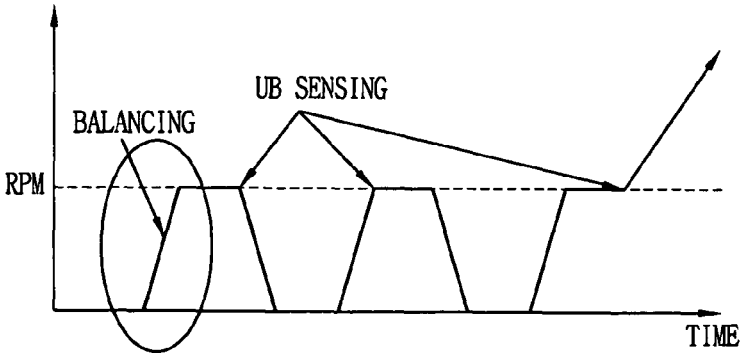
FIG. 2 RELATED ART
FIG. 2 is a graph illustrating a dehydrating process of a washing machine according to the related art.
Figure 3:
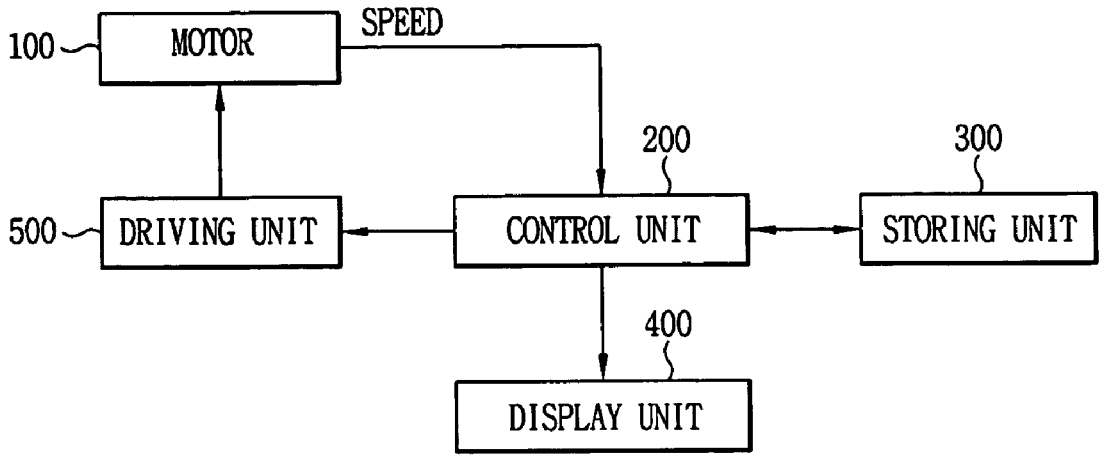
FIG. 3 is a block diagram illustrating a construction of a dehydration controlling apparatus for a washing machine in accordance with an embodiment of the present invention.

FIG. 3 is a block diagram illustrating a construction of a dehydration controlling apparatus for a washing machine in accordance with an embodiment of the present invention.

As illustrated in FIG. 3, a dehydration controlling apparatus for a washing machine according to the present invention is provided with a motor 100, a driving unit 500, a storage unit 300, a display unit 400 and a controlling unit 200.

The motor 100 rotates a washing tub within the washing machine. The driving unit 500 drives the motor 100. The storage unit 400 pre-stores an optimal acceleration rate, an acceptable maximum UB amount and an acceptable minimum UB amount according to an amount of laundry.

The controlling unit 200 performs an overall control for washing operations. The controlling unit 200, according to the present invention, repeatedly controls an operation of increasing and decreasing the RPM of the motor in a range between the acceptable maximum UB amount and the acceptable minimum UB amount until an UB amount detected is less than the allowable minimum UB amount.

If the operation of increasing and decreasing the RPM is repeatedly performed over a certain number of times, the controlling unit 200, identifies the laundry load as a small load and proceeds to dehydrate the washing machine using a preset small load dehydrating algorithm.

Figure 4:
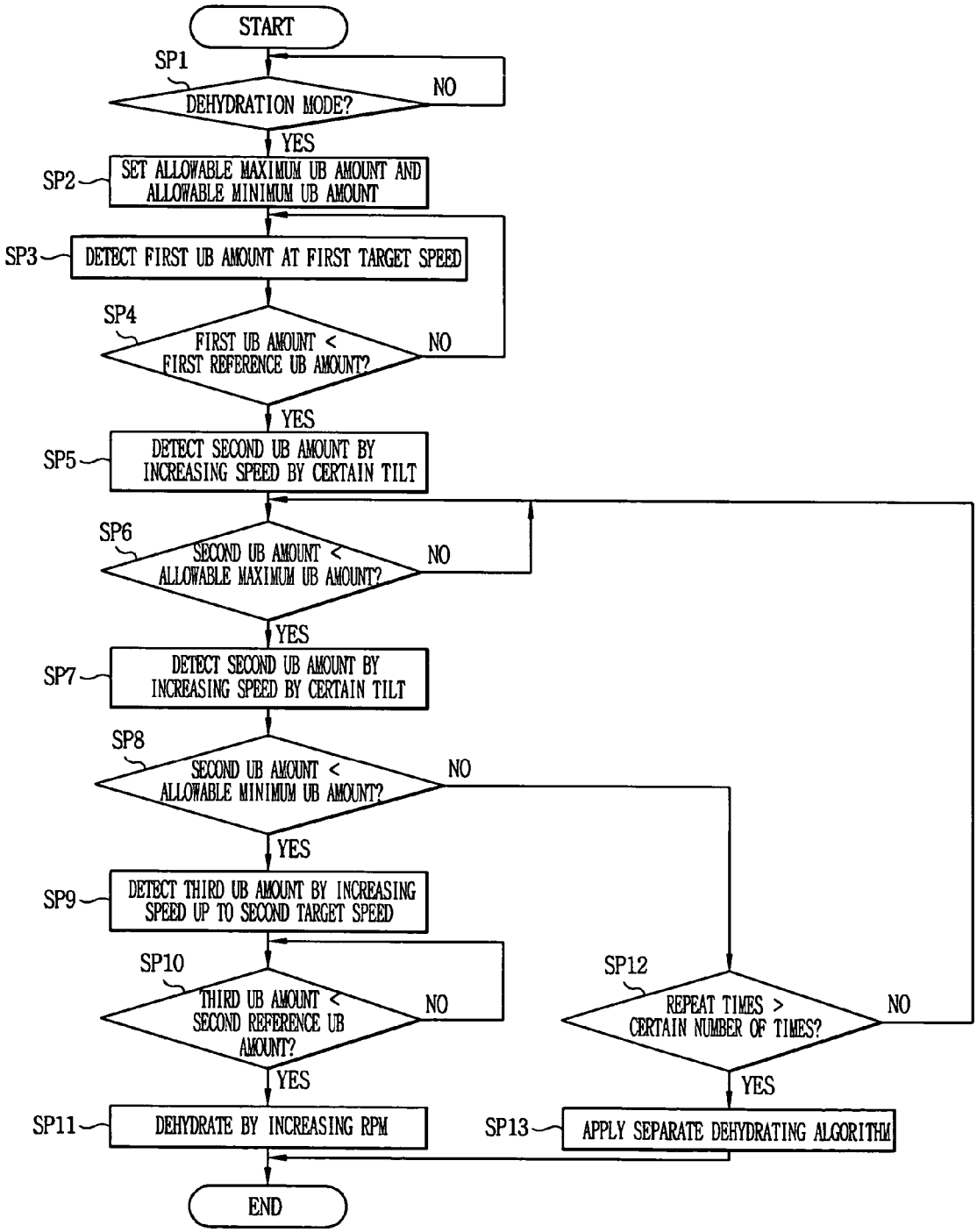
FIG. 4 is a flowchart illustrating a dehydration controlling method for washing machine in accordance with an embodiment of the present invention.

The present invention will now be explained in more detail with reference to FIG. 4.

First, the storage unit 300 pre-stores an optimal acceleration rate, an acceptable maximum UB amount and an acceptable minimum UB amount according to an amount of laundry.

The storage unit 300 is formed, for example, as a Read-Only Memory (ROM) table showing a database of the tilt, the acceptable maximum UB amount and the acceptable minimum UB amount corresponding to the amount of laundry.

The controlling unit 200 sets the acceleration rate, the acceptable maximum UB amount and the acceptable minimum UB amount corresponding to the amount of the laundry by selecting the values from the storage unit 300 (SP1 and SP2).

Next, after increasing a speed of the motor 100 of the washing machine up to a first target speed, the controlling unit 200 determines a first UB amount at the first target speed (SP3), and compares the first UB amount to a first reference UB amount (SP4).

When the first UB amount is less than the first reference UB amount according to the comparison, the controlling unit 200 increases the RPM of the motor to determine a second UB amount (SP5), and thereafter compares the second UB amount to the acceptable maximum UB amount and the acceptable minimum UB amount (SP6).

The controlling unit 200 repeatedly determines the second UB amount and performs the operation of increasing or decreasing the RPM of motor of the washing machine (SP7 and SP8) until the second UB amount is less than the acceptable minimum UB amount.

Figure 5:
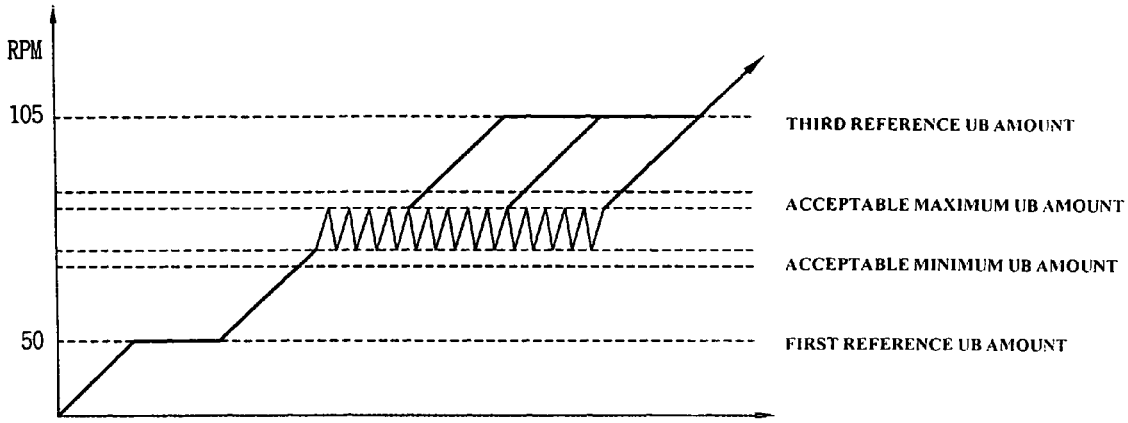
FIG. 5 is a graph illustrating a dehydrating process of a washing machine according to the present invention.

As shown in FIG. 5, when the second UB amount is determined to be greater than the acceptable maximum UB amount, the controlling unit 200 decreases the RPM of the motor by a predetermined amount (SP7). When the second UB amount is greater than the acceptable minimum UB amount (SP8) but less than the acceptable maximum UB amount, the controlling unit 200 re-increases the RPM by a predetermined amount (SP5). Such operations are repeatedly performed until the second UB amount is determined to be less than the acceptable minimum UB amount.

Here, the controlling unit 200 determines whether the operation of increasing or decreasing the RPM is repeatedly performed more than a predetermined number of times (SP12). If it is determined that the operation is repeatedly performed more than the predetermined number of times, the controlling unit 200 identifies the laundry load as a small load to thereby employ a separate dehydrating algorithm (SP13).

In the related art, the UB amount is detected by repeatedly increasing the RPM of the motor and then decreasing the RPM to detect the UB amount. If the case where the UB amount detected is less than the reference UB amount is repeated more than a predetermined number of times, it is identified as the small load. Such stages thus take a long time. On the other hand, regarding the present invention, the UB amount is first determined at a range including an acceptable minimum UB amount and an acceptable maximum UB amount. This range is at an RPM lower than the RPM at the time the third UB is determined. The operation of increasing or decreasing the RPM of the washing machine is then repeatedly performed more than a predetermined number of times to detect the second UB amount, which should be within the region including the acceptable UB amounts. If the UB amount detected does not reach the acceptable UB amounts within another predetermined number of times, it is determined as a small load. The separate dehydrating algorithm is accordingly applied. Through the stages, a dehydration initiating time can be shortened.

Next, when the second UB amount is less than the acceptable minimum UB amount, the controlling unit 200 increases the RPM of the washing machine up to a second target speed to detect a third UB amount (SP9). The controlling unit 200 then compares the third UB amount detected at the second target speed to a second reference UB amount. The controlling unit 200 then determines whether to further increase the RPM according to the comparison (SP10).

When the third UB amount detected by increasing the RPM up to the second target speed is less than the second reference UB amount, the controlling unit 200 increases the RPM of the motor to thereby perform the dehydration (SP11).

In the present invention, before the RPM reaches the speed for initiating the third UB amount determination, in the state of having set the range between the separate acceptable UB amounts, the RPM is increased or decreased to the UB amount determined at the current RPM of the washing machine within the range of the acceptable UB amounts, so as to more evenly distribute clothes within the tub.

As described above, in the present invention, the dehydration controlling apparatus for a washing machine and a method thereof are capable of shortening a dehydration initiating time and reducing noise and vibration by re-distributing the clothes in the wash tub by increasing and/or decreasing the RPM of the motor of the washing machine to allow the second UB amount detected at a current RPM of the washing machine to be within the range between the acceptable UB amounts, before the RPM reaches a speed for initiating the third UB amount determination.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A dehydration controlling apparatus for a washing machine comprising:

a motor for rotating a washing tub within the washing machine;

a driving unit for driving the motor;

a storage unit in which an acceleration rate, an acceptable maximum unbalance amount and an acceptable minimum unbalance amount according to an amount of laundry in the machine are pre-stored, wherein the region between the acceptable maximum unbalance amount and the acceptable minimum unbalance amount is set between a clothes centrifugally-distributing region and a clothes tumbling region for evenly distributing clothes; and a controlling unit for repeatedly controlling an operation of increasing and decreasing a Rotation Per Minute (RPM) of a motor of the washing machine in a region between the acceptable maximum unbalance amount and the acceptable minimum unbalance amount until an unbalance amount detected is less than the allowable minimum unbalance amount, wherein when the operation of increasing or decreasing the RPM is repeatedly performed over a certain number of times, the controlling unit senses the condition as a small load and employs a small load dehydrating algorithm.

2. The apparatus of claim 1, wherein the region between the acceptable maximum unbalance amount and the acceptable minimum unbalance amount is variably applied according to the amount of the laundry in the machine when increasing and decreasing the RPM.

3. The apparatus of claim 1, wherein the region between the acceptable maximum unbalance amount and the acceptable minimum unbalance amount has a separate acceleration rate.

4. The apparatus of claim 1, wherein when the unbalance amount detected is less than the acceptable minimum unbalance amount, the controlling unit increases the RPM of the washing machine and then applies a separate reference unbalance amount thus to perform the dehydration.

5. A dehydration controlling method for a washing machine comprising:

setting a region separately having an acceptable maximum unbalance amount and an acceptable minimum unbalance amount, wherein the region between the acceptable maximum unbalance amount and the acceptable minimum unbalance amount is set between a centrifugally-distributing region and a tumbling region for evenly distributing the laundry;

detecting an unbalance amount by increasing or decreasing a Rotation Per Minute (RPM) of a motor of the washing machine within the set region during a dehydration mode activated, which is repeatedly performed until the unbalance amount detected is less than the acceptable minimum unbalance amount; and sensing a small load of laundry when the operation of increasing and decreasing the RPM of the washing machine is repeatedly performed over a predetermined number of times and accordingly performing a separate small load dehydrating algorithm.

6. The method of claim 5, wherein the region between the acceptable maximum unbalance amount and the acceptable minimum unbalance amount is variably applied according to the amount of the laundry when increasing and decreasing the RPM.

7. The method of claim 5, wherein the region between the acceptable maximum unbalance amount and the acceptable minimum unbalance amount separately has an acceleration rate.

8. The method of claim 5, further comprising increasing the RPM of the washing machine when the unbalance amount detected is less than the acceptable minimum unbalance amount, and employing a separate reference unbalance amount thus to perform the dehydration.

9. A dehydration controlling method for a washing machine comprising:

setting a region having an acceptable maximum unbalance amount and an acceptable minimum unbalance amount, wherein the region between the acceptable maximum unbalance amount and the acceptable minimum unbalance amount is set between a centrifugally-distributing region and a tumbling region for evenly distributing the laundry;

increasing a Rotation Per Minute (RPM) of a motor of the washing machine to detect a first unbalance amount at a first target speed, and increasing the RPM by a certain tilt to detect a second unbalance amount when the first unbalance amount is less than a first reference unbalance amount;

comparing the second unbalance amount to the acceptable maximum unbalance amount and the acceptable minimum unbalance amount, and, increasing or decreasing the RPM, according to the comparison, until the second unbalance amount is less than the acceptable minimum unbalance amount;

increasing the RPM up to a second target speed when the second unbalance amount is less than the acceptable minimum unbalance amount within a certain time, and thereafter comparing a third unbalance amount detected at the second target speed to a second reference unbalance amount, to accordingly determine whether to further increase the RPM of the washing machine; and sensing a small load when the operation of increasing and decreasing the RPM of the washing machine is repeatedly performed over a predetermined number of times, and accordingly performing a separate small load dehydrating algorithm.

10. The method of claim 9, wherein the acceptable maximum unbalance amount and the acceptable minimum unbalance amount have different values according to the amount of the laundry.

11. The method of claim 9, wherein the increasing or decreasing of the RPM includes increasing the RPM of the motor of the washing machine by a preset acceleration rate according to the amount of the laundry in the machine.

12. The method of claim 9, wherein the determining whether to further increase the RPM includes increasing the RPM of the washing machine to perform the dehydration when the third unbalance amount detected is less than the second reference unbalance amount.

* * * * *